United States Patent [19]

VanderKelen et al.

[11] 4,202,496

[45] May 13, 1980

[54] SNOW MAKING SYSTEM

[75] Inventors: James B. VanderKelen, Midland; James L. Dilworth, Petoskey, both of Mich.

[73] Assignee: Snow Machines, Inc., Midland, Mich.

[21] Appl. No.: 958,033

[22] Filed: Nov. 6, 1978

[51] Int. Cl.[2] ..... F25C 3/04

[52] U.S. Cl. ..... 239/14; 239/77; 239/222.11; 62/121; 261/30; 261/89

[58] Field of Search ..... 261/30, 89, 90; 62/74, 62/121; 239/2 R, 2 S, 14, 77, 214.25, 222.11, 418

[56] References Cited

U.S. PATENT DOCUMENTS

| | | | |
|---|---|---|---|
| 2,676,471 | 4/1954 | Pierce, Jr. | 239/2 S X |
| 2,968,164 | 1/1961 | Hanson | 62/74 |
| 3,610,527 | 10/1971 | Ericson et al. | 239/2 S |
| 3,703,991 | 11/1972 | Eustis | 239/2 S |
| 3,838,815 | 10/1974 | Rice | 239/14 |
| 4,004,732 | 1/1977 | Hanson | 239/2 S |

*Primary Examiner*—Andres Kashnikow

[57] ABSTRACT

An improved snowmaking apparatus comprising a water source and an atomizing fan wherein during a snowmaking operation water is placed onto the rotating blades of an atomizing fan, the water exiting from the trailing edges of the blades as droplets, the improvement comprising providing a ducted fan behind the atomizing fan, the ducted fan during operation blowing ambient air towards and over the atomizing fan.

1 Claim, 3 Drawing Figures

SNOW MAKING SYSTEM

BACKGROUND OF THE INVENTION

In the past number of years there has been a continuously increasing surge of interest in winter sports activities, particularly those activities which need a snow base for operation, e.g., skiing, snowmobiling, snowshoeing and the like. Unfortunately, in many areas of the world the natural snow fall is not predictable nor sufficient to assure continuous operation during the season of sports areas and resorts having facilities for such winter sports.

In more recent years continuity of operation and a good snow base has been gained by the use of snow-making machines and apparatus. With such equipment snow-based winter sports activities have been continuously operated during the winter season and extended to geographical areas of the United States; for example, as far south as North Carolina, Virginia and Tennessee even though there is usually not sufficient natural snow in these areas to permit such sports on a regular basis during the season.

With snow making equipment it is essential only that there be an ambient temperature below about 32° F. (0° C.) for a period sufficient to permit snow making to continue until an adequate depth of snow is deposited on the area, terrain or slope desired to be covered. In areas of North Carolina and Tennessee, for example, during a typical winter sports season there may be only 25 days with good conditions for making snow. Farther north in Ohio 30 to 40 days snow making operation ordinarily can be expected and in Michigan 50 days or more are not uncommon. Therefore, it is important for effective operation that large volumes of snow be made rapidly during those periods when conditions are right for mechanical snow making.

Snow making apparatus and machines which have gained widespread commercial acceptance to date have varied both in the type of construction and correspondingly in their method of operation to generate snow. The term "snow" as used herein will refer to the crystallized product resulting from the crystallization of finely divided droplets of a water spray which are deposited at a distance remote from the water droplet generating site. Representative of such apparatus are those which in operation provide a stream, or multiple streams or jets of water, which impinge on rotating fan blades and are atomized into fine droplets as these are driven off the trailing edge of each blade.

Other examples of snow making machines are those which operate by mixing a stream, or multiple streams or jets of water, with compressed air to generate finely divided water droplets, transporting the droplets away from the site of their formation by force of the compressed air being exploded through an orifice. Other methods and apparatus use a fan in combination with compressed air guns. This fan or a second blower operating at ambient pressure and/or a combination of these, effect at least partial crystallization of the water droplets into snow during such transporting.

Illustrative of such apparatus is that disclosed by Pierce in U.S. Pat. No. 2,676,471. This machine mixes compressed air with water within a spray nozzle to effect particle formation of the water along with a cooling of the water which results from the adiabatic expansion of the compressed air. In commercial practice it has been found that the Pierce machine is highly susceptible to nozzle freezing. Additionally, excluding wind factors, this apparatus depends on the force of the compressed air and water themselves to move the freezing water particles beyond the immediate area of the nozzle.

Eustis in U.S. Pat. No. 3,703,991 utilizes a large fan to move particles away from a spray nozzle, but also provides additionally a system wherein compressed air and water are mixed within a first seeding nozzle as taught earlier by Pierce and water is added to the fan moved air by a second exterior nozzle. The seeding nozzles are disposed within the protective cowling of the fan; this can lead to frozen nozzles and increased mechanical difficulties in cleaning and repair. In commercial operations this apparatus has been shown to convert as much as 200 to 250 gallons of water per minute into snow under optimum conditions.

Hanson in U.S. Pat. No. 2,968,164 discloses a different type of snow making apparatus that has become commercially available. This machine includes a high powered fan for providing a substantially unidirectional high volume of air at substantially atmospheric pressure and in combination therewith an independent water spray providing means downstream from the fan. This water spray means is designed and positioned to provide a water spray which is injected into the high volume air movement from the fan at a rate and in a quantity sufficient to achieve crystallization of a substantial amount of the spray droplets and deposition of these as snow. This machine has the advantage that it operates without requiring the use of compressed air although compressed air can and often is used for nucleation. Other nucleation methods may also be used.

Ericson et al. in U.S. Pat. No. 3,610,527 have taught another modification of the apparatus of U.S. Pat. No. 2,968,164 whereby with an 18 or 20 inch fan blade from about 3 to about 140 gallons of water per minute can be converted into snow depending on the rate of rotation of the fan propeller, ambient temperature and relative humidity, and the temperature of the feed water.

Hanson in U.S. Pat. No. 4,004,732 teaches an improvement in machines for making artificial snow of the type in which during operation a water spray is directed into a high volume unidirectional mechanical movement of air, such as generated by a fan, at substantially atmospheric pressure to effect crystallization of the droplets of water in the spray and subsequent deposition of the resultant crystals (hereinafter referred to as "snow") at a position remote from the snow-making machine as snow by regularly redirecting the direction of the discharge end of the snow making apparatus during operation and to a new and useful method for efficiently producing such snow.

BRIEF DESCRIPTION OF THE INVENTION

In brief, the present invention relates to an improvement in a snow making machine and process of the type wherein streams or jets of water are directed, when temperatures are appropriate for snow making, for example, at about a maximum of about 30° F., onto the rotating blades of an atomizing fan. The water is directed by centrifugal force from the rotating fan blades over the surfaces of the fan blades to their outboard edges where it comes off of the trailing edge of each blade as atomized droplets. These droplets in turn are propelled by the draft air movement from the fan upwardly and outwardly to a location remote from the fan becoming at least partially crystallized into snow before striking the terrain.

In general, the improvement of the present invention comprises providing a ducted fan rearward of the atomizing fan, said ducted fan during operation providing a substantially unidirectional stream of air flowing toward the atomizing fan. With this unique and novel improvement, minor increases in horsepower, for example, only two to three hoursepower based on a 15 to 20 horsepower unit of the drive motor for the fan significantly increases the total amount, quality and throw of the snow away from atomizing site.

More particularly, the improvement of the present invention comprises a ducted fan affixed rearward of the motor. Preferably, this second fan is attached to the same shaft, or a second shaft on the same axis and operated by the motor rotor as this drives the atomizing fan. The blades of the ducted fan are of a pitch design to draw air into the shroud of the fan at the end remote from the atomizing fan and discharge it from the other end adjacent the atomizing fan.

The shroud of the ducted fan, which is circular in cross-section ranges from about one to about three times the diameter of the measurement from tip to tip of the longest blades of the atomizing fan and preferably is about one and two-tenths times larger than this blade diameter. In any event, the shroud is of a diameter greater than the pattern formed by the water streams or jets.

The shroud is positioned with reference to the atomizing fan such that the open front end adjacent this fan is from about two inches to about seven feet, and preferably from about two feet to about four feet behind the blades of this fan. The back end of the shroud at least encloses the blades of the second fan but can extend rearwardly behind this fan.

In operation, water under pressure in a stream or multiplicity of streams or jets, as from an annular ring manifold positioned rearward of the blades of the atomizing fan, is directed so as to inpinge on and flow over the surfaces of the rotating atomizing fan blades in a thin film being carried over and providing an atomized spray off the trailing edge of each fan blade. Usually, the atomizing fan has a multiplicity of blades, for example, from six to forty-eight, and ordinarily twelve having a pitch to cause an appropriate updraft of air thereby causing the atomized liquid drops to move up and out away from the fan blades. Further, the atomizing fan may be configured such that there are longer blades and shorter blades which aid in nucleation of the cold water particles. Air at ambient pressure in an amount of at least about 1000 cubic feet per minute and a velocity of from about 15 to about 70 miles per hour is pushed by the ducted fan toward and over the atomizing fan. This improvement results even at temperatures as high as 28° F. to 30° F. in an increase of good quality snow as much as three times greater than achieved with the same snow making machine without the ducted fan. At air velocities of less than about 15 miles per hour no improved effect is measurable and at velocities in excess of 70 miles per hour slushy snow or only wet spray results.

DESCRIPTION OF A PREFERRED EMBODIMENT

Figure 1:
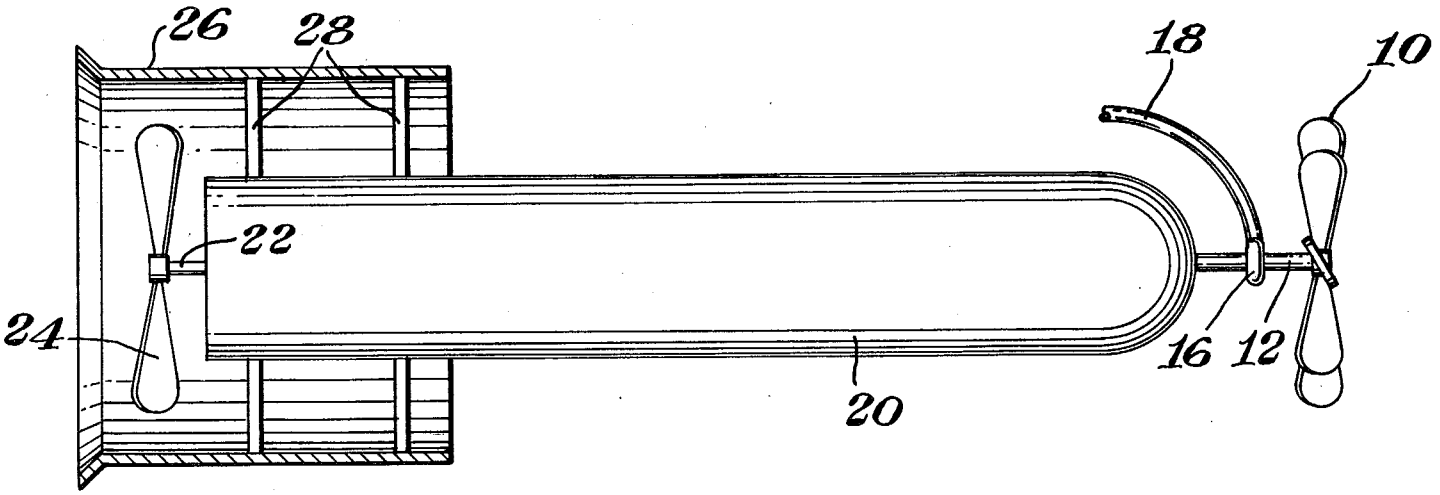
FIG. 1 is a side elevation, partly in section, of one embodiment of the improved snow making machine of the present invention.
Figure 2:
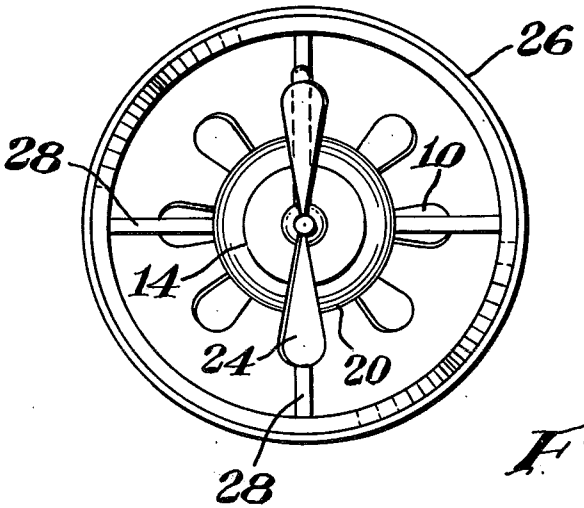
FIG. 2 is an end view of the embodiment of FIG. 1 looking forward from the shrouded fan end.
Figure 3:
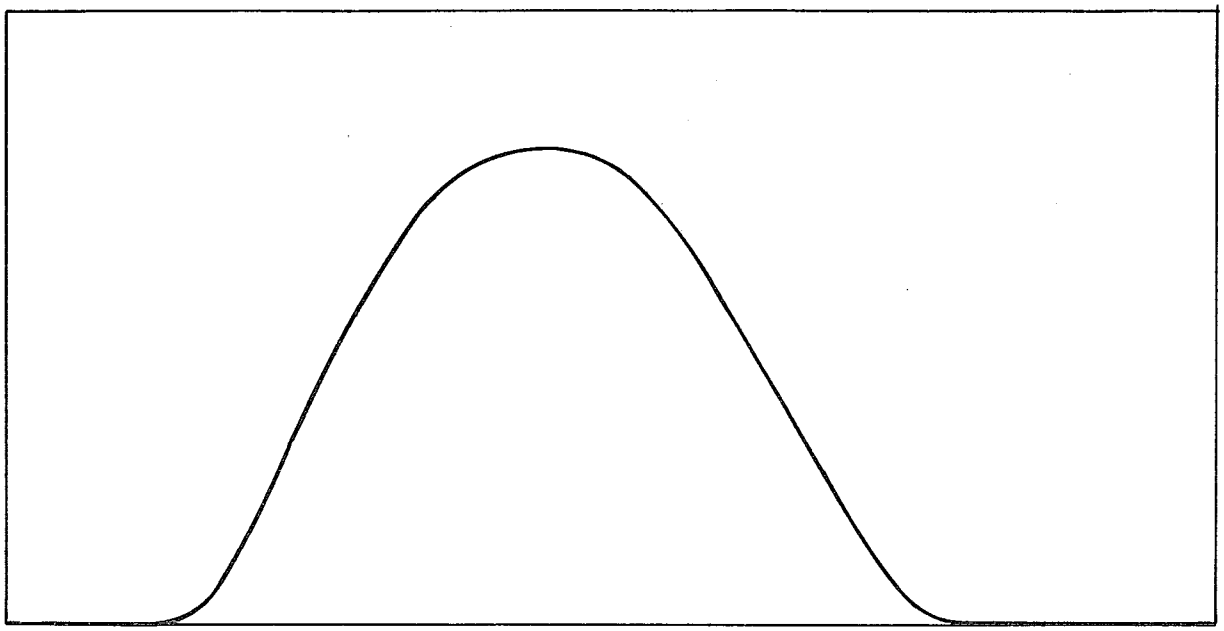
FIG. 3 is a graphical representation illustrating the effective snow-making range resulting from operation of the improved snow-making apparatus of the present invention.

One preferred embodiment of the improved snow making machine of the present invention comprises a 12 bladed atomizing fan 10 having six blades, each pair of which from tip to tip measures 20 inches, and six blades, one each positioned between each two of the individual ten inch blades, and each pair of which measures 18 inches from tip to tip. Fan 10 is attached through shaft 12 to a 15 to 20 horsepower electric motor 14. Between the back side of fan 10 and motor 14 is an annular hollow ring 16 which surrounds shaft 12. This ring 16 has a plurality of holes, usually about five thirty-seconds inch in diameter spaced apart around the wall of ring 16 adjacent the blades of fan 10. Ring 16, which serves as a manifold for delivery of streams or jets of water onto the blades of fan 10 during operation is positioned about five-eighths of an inch behind the fan. Ring 16 is connected by conduit 18 to a high pressure water supply, not shown. The diameter of ring 16 is such that during operation the streams or jets of water emanating therefrom strike the blades of fan 10 relatively close to the hub by which they are attached to shaft 12. Shaft 12 and motor 14, in the embodiment depicted in the FIGS. of the drawing, is encased in a cylindrical housing 20 which has it forward end behind ring 16 and its rear end at least covering a portion of the motor 14. Extending rearwardly of motor 14 is shaft 22, which is on the same axis as shaft 12. Fan 24 having blades with a pitch so as to pass ambient air forward towards atomizing fan 10 is attached to shaft 22 in the rearward portion of housing 20. The number and size of the blades of fan 24 are determined such that during operation this fan 24 provides an air flow of from about 15 to about 70 miles per hour and in a quantity of at least 1,000 cubic feet per minute. Surrounding fan 24 is a generally cylindrical shroud 26 attached by supports 28 to the outer casing of housing 20. The shroud 26 has an inside diameter of about one and two-tenths times larger than the diameter of the circle formed by the larger of the blades of atomizing fan 10. The shroud 26 extends rearward to at least encase the blades of fan 24 and forward to a distance of about three feet behind the blades of fan 10.

In operation of this embodiment of improved snow making machine, with the motor 14 rotating at about 3,450 revolutions per minute, the ducted fan 24 provides a flow of ambient air at about 45 miles per hour. At a temperature of about 20° F., good quality snow is obtained at a water flow rate of about 45 gallons per minute onto the blades of the atomizing fan 10. This produces about three-tenths of an acre-inch of snow per hour wherein the maximum throw of the snow from the machine is about 120 feet.

Using this same machine, but without having the ducted fan 24 of the present improvement, under the same temperature conditions good snow is obtained with up to 32 gallons of water per minute. From such amount of water, two-tenths acre inch of snow per hour is deposited with a throw of up to 50 feet from the machine. Not only is the total snow production less, but there is increased down time since the reduced area of snow throw means that the machine must be shut off and moved from place to place to achieve the same breadth of snow coverage.

At a temperature of ten degrees Fahrenheit and under the same motor speed as for the previous operation, the improved snow making machine of the present invention can atomize about 90 gallons of water per minute producing about six-tenths acre-inch of snow per hour. Without the ducted fan the machine can generate a maximum of about four-tenths acre-inch snow per hour at a water consumption rate of about 60 gallons per minute.

What is claimed is:

1. In a snowmaking apparatus comprising a multi-bladed atomizing fan and a water supply source rearwardly of the blades of said fan, said water supply source providing during operation a multiplicity of water jets onto the blades of said fan, and a power supply attached by a shaft to said atomizing fan, the improvement which comprises, including a ducted fan positioned rearward of said atomizing fan, said ducted fan during operation blowing ambient air toward said atomizing fan and wherein the blades of said ducted fan are attached to a shaft extending rearwardly of the same power supply driving said atomizing fan during operation, said shaft being on the same axis as the shaft having the atomizing fan affixed thereto, and the shroud of said ducted fan having an internal diameter of from one to about three times the diameter of the atomizing fan blades and the front end of said shroud being positioned from about two inches to about seven feet behind the blades of said atomizing fan and the rearward end of said shroud at least enclosing the blades of said ducted fan.

* * * * *